US005365815A

United States Patent [19]

Pfaff, Jr.

[11] Patent Number: 5,365,815

[45] Date of Patent: Nov. 22, 1994

[54] ROTARY SCRAP STRIPPER

[76] Inventor: Alan R. Pfaff, Jr., 3512 MacNichol Trail, Orchard Lake, Mich. 48323

[21] Appl. No.: 166,606

[22] Filed: Dec. 13, 1993

Related U.S. Application Data

[63] Continuation of Ser. No. 3,295, Jan. 12, 1993, abandoned.

[51] Int. Cl.[5] ..... B26D 1/36; B26D 1/40

[52] U.S. Cl. ..... 83/154; 83/128; 83/345

[58] Field of Search ..... 83/107, 151, 154, 128, 83/345; 493/342, 373, 472

[56] References Cited

U.S. PATENT DOCUMENTS

| | | | |
|---|---|---|---|
| 3,222,968 | 12/1965 | Larson | 83/128 |
| 3,320,864 | 5/1967 | Zernov | 493/373 |
| 3,371,584 | 3/1968 | Zernov | 493/373 |
| 3,435,737 | 4/1969 | Sarka . | |
| 3,827,322 | 8/1974 | Saunders et al. . | |
| 4,295,842 | 10/1981 | Bell . | |
| 4,306,476 | 12/1981 | Saunders et al. . | |
| 4,367,069 | 1/1983 | Bishop | 493/343 |
| 4,499,802 | 2/1985 | Simpson . | |
| 4,561,334 | 12/1985 | Sarka . | |
| 4,608,895 | 9/1986 | Bell et al. . | |
| 4,691,603 | 9/1987 | Winnemöller | 83/151 |
| 4,759,247 | 7/1988 | Bell et al. . | |
| 4,905,599 | 3/1990 | Richey | 83/151 |
| 5,087,237 | 2/1992 | Nunley | 493/342 |
| 5,111,725 | 5/1992 | Simpson et al. . | |

*Primary Examiner*—Rinaldi I. Rada
*Assistant Examiner*—Kenneth E. Peterson
*Attorney, Agent, or Firm*—Barnes, Kisselle, Raisch, Choate, Whittemore & Hulbert

[57] ABSTRACT

A piece of scrap material cut from a web passing through the nip of a pair of rotary cutting dies is removed by a mechanism with an actuator carried by one of the cylinders, a pin and ejector sleeve carried by the other cylinder and a release roller downstream of the nip and adjacent the other cylinder. As the scrap piece is cut from the web it is impaled on the pin by cooperation with the actuator which also retracts the sleeve to expose the pin and actuates an indexable ring to releasably retain the sleeve in a retracted position from the head of pin. The scrap piece is impaled on the pin and is carried away from the nip and web by rotation of the other cylinder and downstream thereof passes through the nip of a roller and the other cylinder which moves the sleeve and actuates the ring to release the sleeve so that as it passes out of the nip it moves to the fully extended position to strip the cut piece from the pin and thereby release and remove it from the cylinder. Preferably, the released scrap piece is propelled into a chute or other container for collecting scrap pieces.

15 Claims, 3 Drawing Sheets

ROTARY SCRAP STRIPPER

This is a continuation of copending application(s) Ser. No. 08/003,295 filed on Jan. 12, 1993, now abandoned.

FIELD OF THE INVENTION

This invention relates to rotary die cutting of blanks from a thin web of material, and more particularly to removing scrap portions after they have been cut from the web by the rotary dies.

BACKGROUND OF THE INVENTION

Previously, blanks having a predetermined desired configuration and associated scrap pieces have been cut from a web of a thin material, such as paper, paperboard, cardboard, plastic film, metal foil, sheet metal and the like, by passing the web through the nip of a pair of rotary cutting dies having blades which sever or cut blanks and scrap portions from the web. Typically, as the cylinders rotate, a piece of scrap material is pierced by a pin fixed to one of the cylinders for rotation therewith. After the scrap piece is carried away from the cutting area by the pin and its associated rotating cylinder, the scrap piece is removed by cooperation with a stripper plate or comb which passes between the leading edge of the scrap piece and the cylinder. The scrap piece is removed from the pin as it passes through a slot between adjacent teeth of the comb. Such prior art scrap removers are disclosed and claimed in U.S. Pat. Nos. 4,295,842 and 4,561,334.

A different stripping comb must be made and used with each cutting die producing blanks or scrap pieces of different shape or location in the web. Considerable time and expense is required to install, align and set up a different comb each time a different rotary die is used in a rotary die cutting machine.

SUMMARY OF THE INVENTION

A scrap piece cut from a web passing through the nip of a pair of rotary cutting die cylinders is removed by a mechanism with an actuator carried by one of the cylinders, a pin and ejector sleeve relatively movable to extended and retracted positions and carried by the other cylinder, and a release disposed downstream of the nip and adjacent the other cylinder. The actuator impales the scrap piece on the pin, and relatively retracts the ejector sleeve as they pass through the nip so that the scrap piece is carried away by rotation of the cylinder carrying the pin and sleeve which are releasably retained in a relatively retracted position. As they pass by the release, it actuates the sleeve to a relatively extended position to remove the scrap piece from the pin and hence the rotating cylinder on which it was carried away from the web. Preferably, the sleeve is releasably retained and actuated preferably by an indexable ring and operably associated cams and followers carried by the sleeve and ring and constructed so that they are reciprocated on the pin alternately by the actuator and release to retracted and extended positions. Preferably, the actuator is a resilient material which bears on the scrap piece when it passes through the nip and the release is preferably a roller preferably with a compliant peripheral surface which bears on the scrap piece when it passes through the nip of the roller and the cylinder carrying the cut piece.

Objects, features and advantages of this invention are to provide a mechanism for removing scrap pieces cut from a web of material passing through the nip of a pair of die cylinders which eliminates a comb, may be used with a variety of cylinders cutting different configurations without modifying or changing the release and removal apparatus, is rugged, durable, requires relatively little service, maintenance and adjustment in use, and is of relatively simple design and economical manufacture, assembly, installation and set up.

BRIEF DESCRIPTION OF THE DRAWINGS

These and other objects, features and advantages of this invention will be apparent from the appended claims, detailed description and accompanying drawings in which:

DETAILED DESCRIPTION

Figure 1:
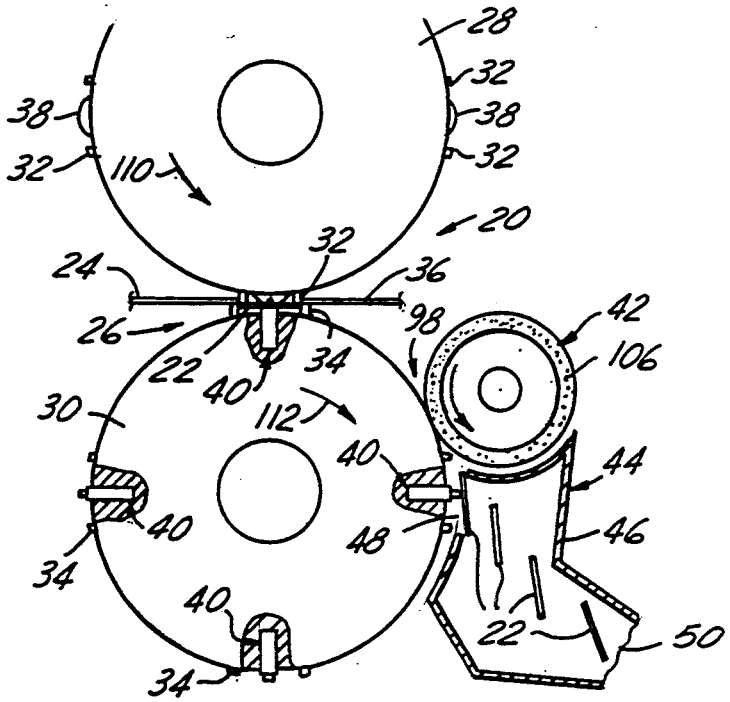
FIG. 1 is a semi-schematic side view of a pair of co-rotating die cylinders with a scrap material removal mechanism embodying this invention associated therewith.

Referring in more detail to the drawings, FIG. 1 illustrates a mechanism 20 embodying this invention for removing a piece of scrap material 22 cut from a web 24 in the nip 26 of a pair of co-rotating die cylinders 28 & 30. Both cylinders may have one or more pairs of cooperating cutting blades 32 and 34 thereon or alternatively one cylinder may have knife edge cutting blades which cooperate with a plain cylindrical anvil surface on the other cylinder. The cylinders 28 & 30 are shown with four pair of equally circumferentially spaced cutting blades 32 & 34 each of which cuts one piece of scrap 22 per revolution of the cylinders so that four scrap pieces are cut per each revolution of the cylinders. Typically, the cylinders cut blanks 36 for a workpiece and at least one, and often several, associated scrap pieces 22 from the web. Typically, the blanks 36 travel downstream of the nip with the web and the scrap pieces are separated from the web. Usually, the web is a thin and elongate sheet of material, such as paper, paperboard, cardboard, plastic, metal foil, sheet metal and the like.

Figure 2:
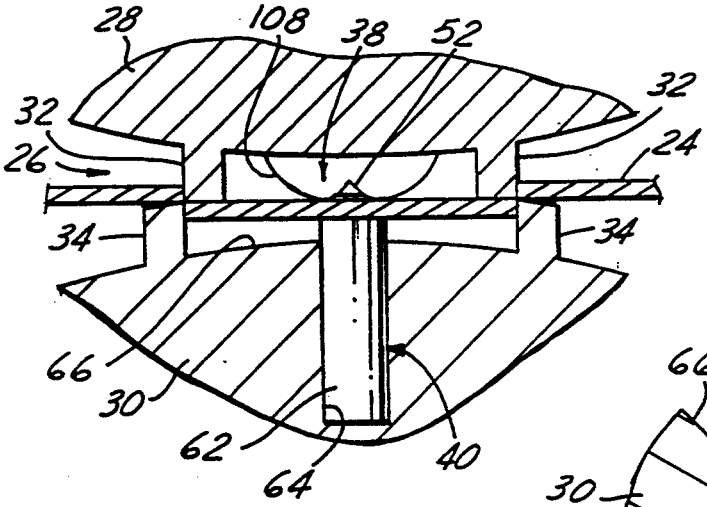
FIG. 2 is an enlarged fragmentary side view of a portion of FIG. 1 illustrating a portion of the mechanism in the nip of the cylinders with an actuator impaling a piece of scrap material on a carrier pin and shifting an associated ejector sleeve to its retracted position.

As shown in FIGS. 1 and 2, the mechanism 20 has an actuator 38 carried by one cylinder, a scrap piece carrier and ejector assembly 40 carried by the other cylinder and a release roller assembly 42 disposed adjacent the other cylinder and downstream of the nip 26. As cut scrap pieces are released, they are deposited in a chute or duct assembly 44. This assembly has a housing 46 with an inlet opening 48 and a discharge opening 50 through which scrap pieces pass when they are released. Preferably, the cut scrap pieces are assisted in moving through the inlet by an air stream produced by evacuating the housing downstream of the inlet.

Figure 5:
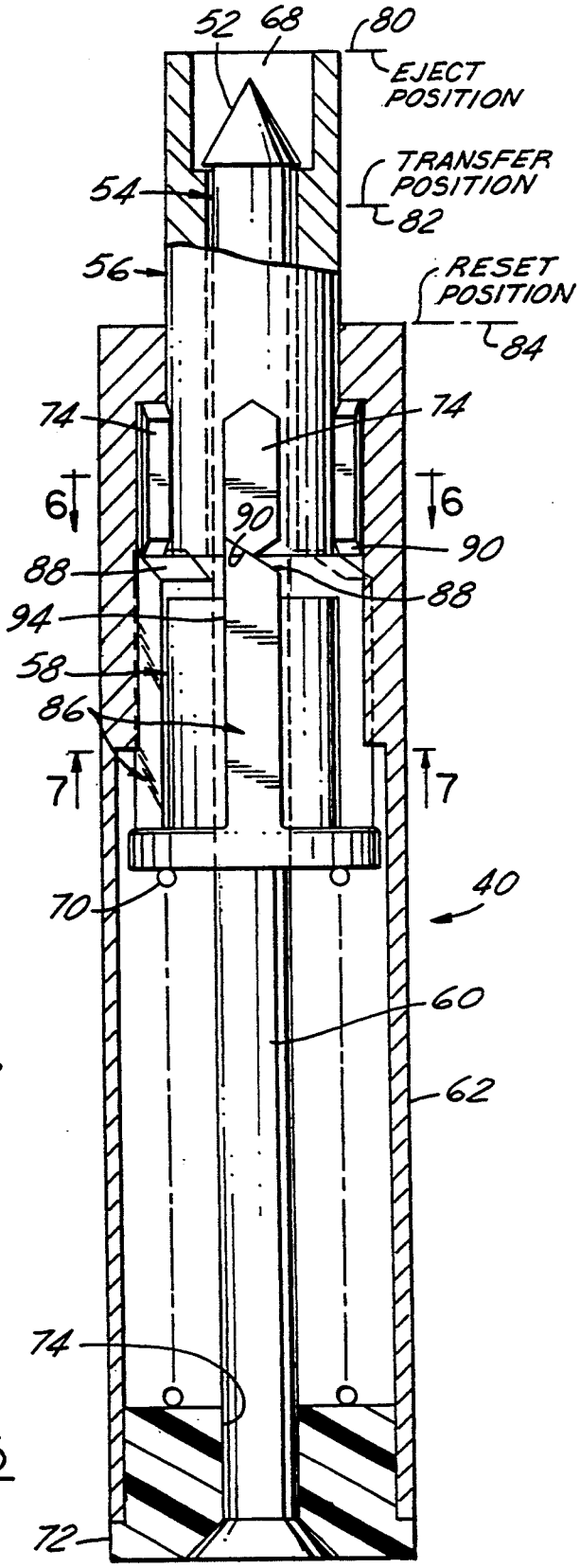
FIG. 5 is an enlarged sectional view of the carrier pin , ejector sleeve and associated housing of the mechanism with the sleeve shown in its extended position.

As shown in FIG. 2, as they pass through the nip, the actuator 38 forces the cut piece 22 over the head 52 of a pin 54 of the assembly 40 so that the cut piece is impaled and carried by the pin. As shown in FIG. 5, an ejector sleeve 56 and an indexable ring 58 are slidably received on the shank 60 of the pin and disposed in a tubular housing 62 which in assembly is received in a blind bore 64 in the die cylinder 30 with the tip of the pin 54 projecting generally radially outward beyond the peripheral surface 66 of the die cylinder. The ejector sleeve 56 is yieldably urged to its extended position so that the tip of the pin 54 is received in a counterbore 68 by a compression spring 70 encircling the pin and bearing on the indexable ring and an end plug 72 which preferably is press fit into the bottom of the housing. Preferably, the pin is press fit or otherwise secured in a bore 74 through the end plug.

The sleeve is guided for generally axial movement relative to the pin and the housing by six keys 74 equally circumferentially spaced on the sleeve which are slidably received in six equally circumferentially spaced guideways or grooves 76 & 78 which extend axially in the housing. All of these grooves have substantially the same width, preferably substantially the same axial length and the grooves 76 have a greater radial depth than the grooves 78. Rotation of the sleeve relative to the housing is also substantially prevented by these keys and grooves.

Figure 8:
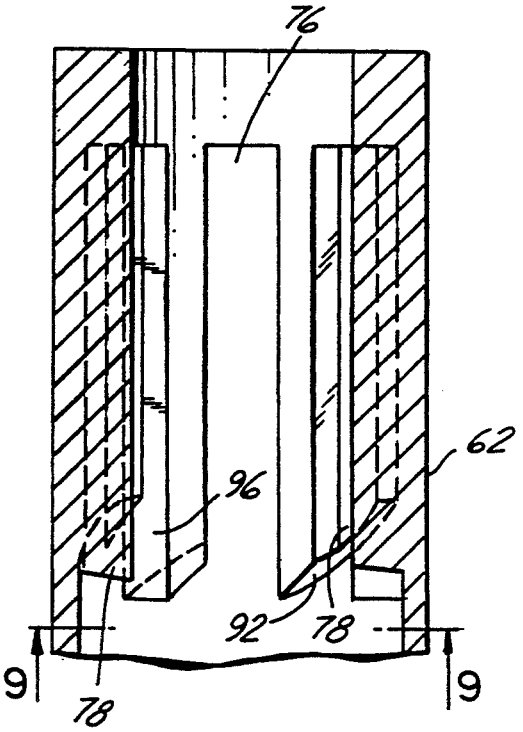
FIG. 8 is a fragmentary full sectional view of the housing for the sleeve and pin.
Figure 7:
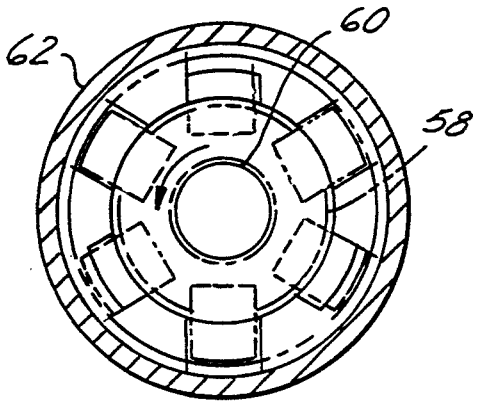
FIG. 7 is an enlarged sectional view taken on line 7—7 of FIG. 5.
Figure 9:
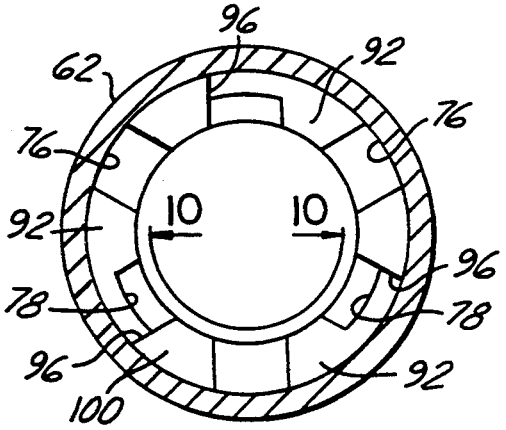
FIG. 9 is an enlarged sectional view taken on line 9—9 of FIG. 8.
Figure 10:
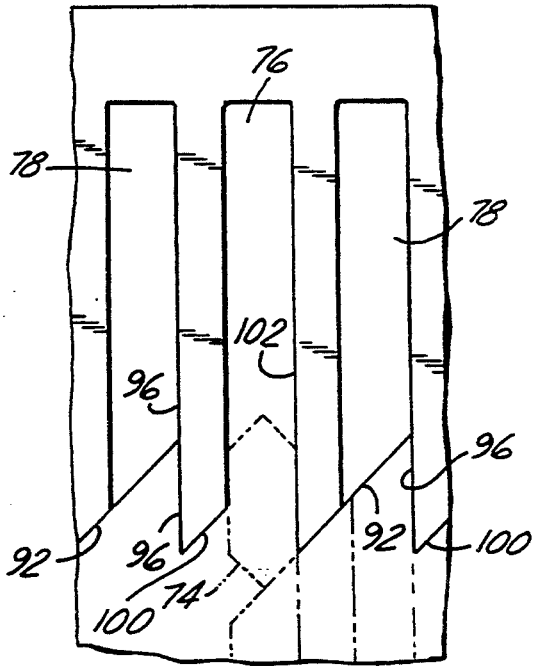
FIG. 10 is an enlarged and fragmentary layout view taken generally on line 10—10 of FIG. 9.

As the sleeve passes into the nip it is moved by the actuator from its fully extended or eject position 80 (FIG. 5), generally axially inward to the retracted or reset position 82, and as the sleeve emerges from the nip it is moved outward by the spring to an intermediate or transfer position 84 where it is releasably restrained by the indexable ring 58 from being moved by the spring further outward toward its eject position. As the sleeve and hence the ring 58 moves inward from the extended to the retracted position, the ring is guided axially and prevented from rotating by three keys or guides 86 equally circumferentially spaced and axially extending on the ring which are slidably received in the three guideways or grooves 76. When the ring reaches its retracted position, the keys 86 disengage from the lower end of the guideways 76 and the ring is indexed clockwise about one sixth of a revolution by the cooperation of inclined follower faces 88 (FIG. 5) on the ends of the keys 86 of the ring initially with the inclined cam faces 90 (FIG. 5) on the ends of the keys of the sleeve and then with the inclined ramps 92 (FIGS. 8 & 10) in the housing due to the force produced by the spring 70. The ring indexes and advances somewhat axially (along with the sleeve) until a leading side edge 94 (FIG. 5) of each ring key bears on an axially extending stop or side face 96 (FIG. 10) of each guideway groove 78. The cooperation of the ramps 92 and stops 96 releasably retains the ring from being circumferentially and axially further advanced by the spring and hence the sleeve is releasably disposed in its intermediate transfer position.

The sleeve is released and moves to its extended or eject position 80 to strip the cut piece 22 off the pin 54 by the assembly 40 passing through the nip 98 between the release roller 42 and the cylinder 30. As the assembly 40 passes into the nip, the roller 42 moves the sleeve 56 axially inward to its retracted or reset position 84 to index the ring 58 and as the assembly passes out of the nip, the spring 70 advances the ring and the sleeve to its fully extended or eject position 80 so that the scrap piece 22 is removed over the head 52 of the pin which is received in the sleeve. As the ring is retracted, it moves axially until its keys 86 disengage from the grooves 76 whereupon the ring is rotated clockwise about one sixth of a revolution by the cooperation of the inclined follower faces 88 (FIG. 5) initially with the sleeve cam faces 90 and then with the inclined ramps 100 in the housing due to the force produced by the spring 70. The ring indexes (and advances somewhat axially until the leading side faces 94 of its keys bear on side faces 102 of the grooves 76 which aligns the ring keys with these grooves 76. As the assembly 40 emerges from the nip 98, the ring is advanced by the spring 70 (with the ring keys 86 in the grooves 76) to the fully extended or eject position (FIGS. 4 & 5), to strip the scrap piece off the pin.

The faces of the followers 88, cams 90, ramps 92 and ramps 100, are all inclined preferably at the same acute included angle to the longitudinal axis which is desirably in the range of 30° to 60° and preferably 40° to 50°.

Figure 3:
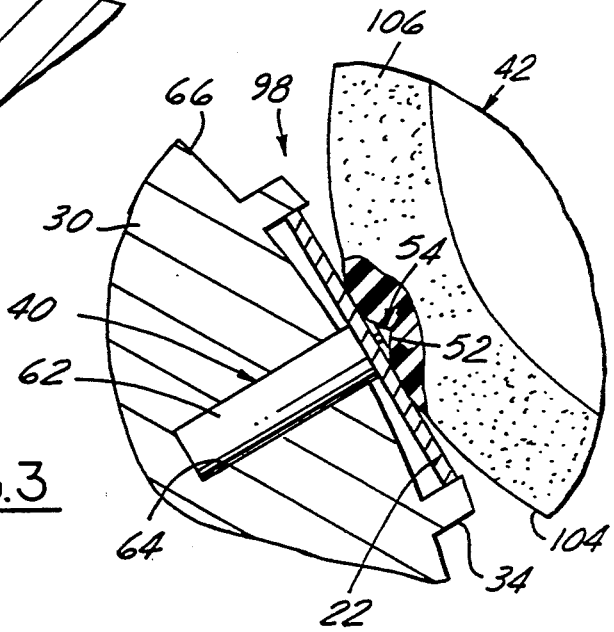
FIG. 3 is an enlarged fragmentary view of another portion of FIG. 1 illustrating cooperation of a release roller with the sleeve and pin of the mechanism to release the sleeve for movement to its extended position.

The release roller 42 preferably has a plain cylindrical peripheral surface 104 and preferably has at least a sleeve 106 or outer peripheral layer of a somewhat compliant material which, as shown in FIG. 3, yields at the point of contact with the tip 52 of the pin 54 while still bearing on the surrounding area of the cut piece 22 with sufficient force to move the sleeve 56 and index ring 58 inward from the transfer position 82 to the retracted or reset position 84 against the bias of the spring 70 to release the ring so that it can be advanced with the sleeve 56 to its fully extended or eject position 80 when it passes out of the nip 98 of roller 42 and cylinders 30. Preferably, the sleeve 106 is of a compliant material, such as neoprene rubber with a durometer value in the range of 40 to 90 and preferably 40 to 60 on a Shore durometer tester. It will be appreciated by skilled persons that, if desired, the periphery of the roller could be of a non-compliant or rigid material, such as steel, with a clearance pocket or recess therein into which the head end of the pin 54 projects as the sleeve is being actuated by the roller.

Preferably, the sleeve 56, index ring 58 and housing 62 are made of a metal, such as steel, and are preferably produced by investment casting to economically produce the relatively complex and intricate shapes of their various guideways, ramps, cams and followers. Preferably, the pin is made of steel, such as 1040 which is hardened and sharpened.

Preferably, the actuator 38 is a body or pad of a resilient material carried by the cylinder 28 and preferably has a generally arcuate or semi-cylindrical peripheral surface 108, the central portion of which bears on the cut piece 22 as the pin and sleeve assembly 40 pass through the nip 26 of the die cylinders. Preferably, the pad 38 is made of a foam material, such as polyurethane, and has a durometer in the range of 40 to 60 and preferably 40 to 50 on the Shore durometer tester. It will be appreciated by skilled persons, that if desired, the actuator pad 38 can be a non-resilient and rigid material, such as steel, with a clearance pocket or recess therein to receive the head end of the pin 54 when they pass through the nip of the die cylinders. If desired, the actuator pad with a recess may be an integral part of the die cylinder 28.

In operation, the surface speed or angular velocity of the periphery of the actuator 38, tip 52 of the pin 56 and cutting blades 32 & 34 of the die cylinders are all substantially the same and equal to the lineal speed at which the web passes through the nip 26 so that there is essentially no relative lineal or arcuate movement between them as they pass through the nip. As indicated in FIG. 1 by the arrows 110 & 112, the cylinders 28 & 30 rotate in opposite directions, such as counterclockwise and clockwise, and the actuator roller 42 rotates in a direction opposite to that of the cylinder 30, such as counterclockwise (all as viewed in FIG. 1). In operation, preferably the roller 42 is driven so that it has substantially the same peripheral surface speed or angular velocity as the cut piece carried by the cylinder 30 so that there is substantially no relative arcuate movement between them as the roller actuates the sleeve to release it for movement to its extended position by the spring.

In operation, as the web 24 passes through the nip 26 of the co-rotating die cylinders 28 & 30, the blades 32 and 34 cut workpiece blanks 36 and associated pieces 22 of scrap material from the web. Typically, the cut blanks travel with the web and the scrap pieces 22 are removed by the mechanism 20. As the pin and stripper assembly 40 approaches the web, the sleeve 56 is in the fully extended position 80 (shown in FIGS. 1 and 5), with the tip 56 of the pin 54 received in the recess 68 of the sleeve. As the assembly 40 is moved into the nip by the rotating die cylinder 30, the actuator pad 38 on the co-rotating die cylinder 28 forces the cut piece over the tip 52 of the pin 56 so that it is pierced and impaled on the pin as shown in FIG. 2. Simultaneously, by bearing on the cut piece 22, the actuator also moves the sleeve 56 inward generally axially with respect to its housing (or generally radially inward with respect to the die cylinder 30) to the retracted position 84 (FIG. 5). This also moves the indexable ring 58 generally axially inward until its keys 86 disengage from the guideway grooves 76 whereupon the ring is rotatably indexed clockwise approximately one sixth of a revolution by the cooperation of the ring followers 88 with the sleeve cams 90 and housing ramps 92 due to the force produced by the compression spring 70. As the pin assembly and sleeve 40 emerge from the nip, the ring and sleeve 56 are axially advanced by the spring to the intermediate transfer position 82 (FIG. 5). The ring (and hence the sleeve) is releasably retained in the transfer position by its followers 88 and key leading side edges 94 bearing on the housing ramps 92 and leading side edges 96 of the grooves 78. With the cut piece 22 received on the pin 54 and the sleeve 56 in its transfer position, the cut piece is moved by the rotating cylinder 30 away from the nip 26 and web 24 of material and advanced into the nip 98 between the actuator rollers 42 and die cylinder 30.

Figure 4:
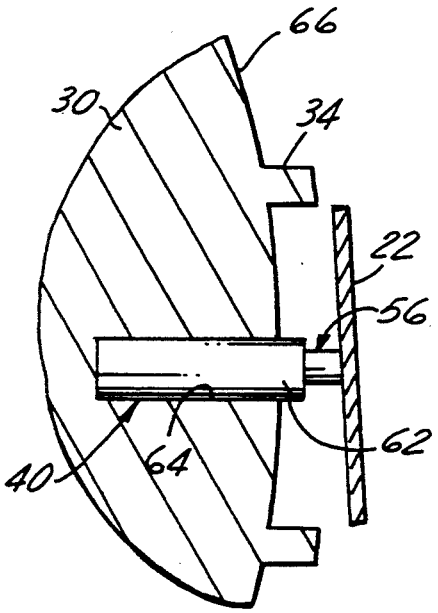
FIG. 4 is an enlarged fragmentary side view of a portion of the mechanism with the sleeve shown in its extended position to strip and remove the cut piece from the pin.
Figure 6:
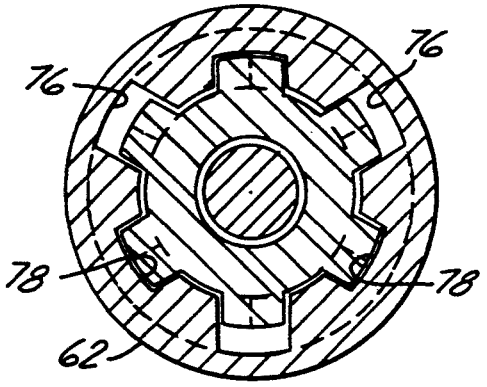
FIG. 6 is an enlarged sectional view taken generally on line 6—6 of FIG. 5.

As they enter the nip 98 the roller 42 bears on the cut piece 22 and moves the sleeve and ring generally axially inward from the transfer position 82 to the retracted position 84 (as shown in FIG. 3 and indicated in FIG. 5), to release the ring 58 (and hence the sleeve 56) for movement outward to the extended position as the sleeve emerges from the nip. The ring moves axially inward until its keys 86 disengage from the housing stop surfaces 96, whereupon the ring is indexed clockwise about one sixth of a revolution (and axially advanced somewhat) by the cooperation of its followers 88 with the sleeve cams 90 and housing ramps 100 and the force produced by the compression spring so that the ring keys 86 become aligned with the guideway grooves 76. As the cut piece and pin assembly 40 emerge from the nip, the roller 42 disengages from the cut piece which permits the sleeve 56 and ring 58 to be generally axially advanced outwardly by the spring to the fully extended or eject position 80 to thereby strip and remove the cut piece from the pin as shown in FIG. 4.

Upon being stripped from the pin, the scrap piece 22 tends to move, as shown in FIG. 1, along a path generally tangent to the arc in which it was traveling at the point of release, and passes into the inlet 48 of the housing 44 for receiving removed scrap pieces 22. Preferably, the interior of the housing is subjected to a partial vacuum, such as by a fan or blower (not shown), to produce an air stream from the atmosphere around, into and through the inlet 48 which assists in propelling the released scrap pieces into the housing.

After the scrap piece is stripped and removed, the sleeve and pin assembly 40 continues to move with the rotating die cylinder 30 so that it again approaches the nip 26 of the die cylinders to impale another piece of scrap material cut from the web and remove it as they pass through the nip.

What is claimed is:

1. A mechanism for removing pieces cut from a web of material comprising:

a pair of cylinders constructed and arranged to be mounted for rotation in generally superimposed relation with a web of material passing through the nip between them, a pin carried by one of the cylinders and having a tip constructed and arranged to pierce a piece of material cut from the web and receive the piece on the pin, a sleeve received over the pin, said sleeve and pin being relatively movable to a first position wherein the tip of the pin projects beyond one end of the sleeve and generally radially outwardly of such one cylinder, and to second position spaced from the first position in which said tip is received in said sleeve, a retainer releasably retaining the sleeve and pin in said relative first position thereof, said retainer having a plurality of circumferentially spaced apart cams operably associated with one of said sleeve and pin, an indexable ring having a plurality of circumferentially spaced apart followers operably associated with at least some of said cams, and a spring yieldably urging at least some of said followers and cams into operative relationship, an actuator carried by the other cylinder and constructed and arranged so that as the pin and sleeve pass through the nip of the cylinders a piece of material cut from the web is pierced by the tip and forced onto the pin, the pin and sleeve are relatively moved from their second position toward their first position and said retainer is actuated to retain them in their first position, and a release adjacent said one cylinder, downstream of the nip of said cylinders, and constructed and arranged to release said retainer when said pin and sleeve pass by said release so that said sleeve and pin relatively move to said second position and thereby strip and remove the cut piece from said pin to release the cut piece from said one cylinder.

2. The mechanism of claim 1 which also comprises a spring operatively associated with at least one of said pin and sleeve and yieldably biasing them toward their relative second position.

3. The mechanism of claim 1 in which said actuator comprises a pad carried by said other cylinder and when said pin passes through the nip being generally opposed thereto with the tip of the pin projecting into said pad.

4. The mechanism of claim 3 in which said pad comprises a resilient material.

5. The mechanism of claim 4 wherein said pad has a clearance recess into which said tip of said pin projects when they pass through the nip of said cylinders.

6. The mechanism of claim 1 wherein the release comprises a roller co-rotating with said one cylinder and constructed and arranged to bear on the cut piece and relatively move said sleeve and pin to release said retainer as the cut piece passes through the nip between said roller and said one cylinder.

7. The mechanism of claim 6 wherein at least the peripheral surface of said roller is of a compliant material.

8. The mechanism of claim 1 which also comprises a plurality of circumferentially spaced first keys carried by said sleeve and extending generally axially thereof, a plurality of circumferentially spaced apart guideways carried by the cylinder carrying the pin and complementarily engageable with at least some of said first keys for restraining rotation of said sleeve relative to the one cylinder carrying the pin while permitting said sleeve to reciprocate generally axially relative to the one cylinder carrying the pin, a plurality of second keys equally circumferentially spaced apart and carried by said ring and receivable in some of said guideways for guiding said ring for generally axial reciprocation relative to the one cylinder carrying the pin, said followers being equally circumferentially spaced apart and carried by said ring, and a plurality of circumferentially spaced apart and inclined ramps carried by the one cylinder carrying the pin and constructed and arranged to cooperate with said followers of said ring to rotatably index said ring and releasably retain the sleeve and pin in said first position thereof.

9. The mechanism of claim 8 wherein said guideways alternate between first and second guideways having a different radial depth with said first guideways having a greater radial depth than the radial depth of said second guideways and said second keys on said ring are slidably receivable in said second guideways and project radially sufficiently that they will overlap and cannot be received in said first guideways.

10. A mechanism for removing pieces cut from a web of material comprising:

a pair of cylinders constructed and arranged to be mounted for rotation in generally superimposed relation with a web of material passing through the nip between them, a housing carried by one of said cylinders a pin carried by said housing and having a tip constructed and arranged to pierce a piece of material cut from the web and receive the piece on the pin, a sleeve received over the pin and disposed in said housing, said sleeve and pin being relatively movable to a first position wherein the tip of the pin projects beyond one end of the sleeve and generally radially outwardly of said one cylinder, and to second position spaced from the first position in which said tip is received in said sleeve, said sleeve and said housing having operably associated keys and guideways permitting axial movement of said sleeve relative to said housing and limiting any rotary movement of said sleeve relative to said housing, a retainer releasably retaining the sleeve and pin in said relative first position thereof, an actuator carried by the other cylinder and constructed and arranged so that as the pin and sleeve pass through the nip of the cylinders a piece of material cut from the web is pierced by the tip and forced onto the pin, the pin and sleeve are relatively moved from their second position toward their first position and said retainer is actuated to retain them in their first position, a release adjacent said one cylinder, downstream of the nip of said cylinders, and constructed and arranged to release said retainer when said pin and sleeve pass by said release so that said sleeve and pin relatively move to said second position and thereby strip and remove the cut piece from said pin to release the cut piece from said one cylinder, and said retainer has an indexable ring received in said housing, a plurality of circumferentially spaced cams and a plurality of followers operably associated with said cams, one of said cams and followers being carried by said sleeve and the other of said cams and followers being carried by said indexable ring, a spring yieldably urging at least some of said cams and followers together into a cooperative relationship and said sleeve towards said second position, and ramps carried by said housing and operably associated with said indexable ring whereby reciprocation of said sleeve and ring by said actuator moves said sleeve to said first position and by said release moves said sleeve to said second position.

11. The mechanism of claim 10 wherein said keys include a plurality of circumferentially spaced first keys carried by said sleeve and extending generally axially thereof and a plurality of equally circumferentially spaced apart second keys carried by said ring, said guideways being circumferentially spaced apart, carried by said housing and complementarily engageable with at least some of said first keys for restraining rotation of said sleeve relative to said housing while permitting said sleeve to reciprocate generally axially relative to said housing and complementarily engageable with at least some of said second keys for guiding said ring for generally axial reciprocation relative to said housing, said followers being equally circumferentially spaced apart and carried by said ring, and a plurality of circumferentially spaced apart and inclined ramps carried by said housing and constructed and arranged to cooperate with said followers of said ring to rotatably index said ring and releasably retain the sleeve and pin in said first position thereof.

12. The mechanism of claim 11 wherein said guideways alternate between first and second guideways having a different radial depth with said first guideways having a greater radial depth than the radial depth of said second guideways, and said second keys on said ring are slidably receivable in said second guideways and project radially sufficiently that they will overlap and cannot be received in said first guideways.

13. A mechanism for removing pieces cut from a web of material passing through the nip of a pair of cylinders constructed and arranged to be mounted for rotation in generally superimposed relation, the mechanism comprising:

a housing constructed to be carried by one of the cylinders, a pin disposed in the housing and having a tip constructed and arranged to project from the housing to pierce a piece of material cut from the web and receive the piece of material on the pin, a sleeve received over the pin and carried by the housing, said sleeve and pin being relatively movable to a first position wherein the tip of the Din projects beyond one end of the sleeve and generally radially outwardly of such one cylinder, and to second position spaced from the first position in which said tip is received in said sleeve, a retainer releasably retaining the sleeve and pin in said relative first position thereof, said retainer having a plurality of circumferentially spaced apart cams operably associated with one of said sleeve and pin, an indexable ring having a plurality of circumferentially spaced apart followers operably associated with at least some of said cams, and a spring yieldably urging at least some of said followers and cams into operative relationship, an actuator carried by the other cylinder and constructed and arranged so that as the pin and sleeve pass through the nip of the cylinders a piece of material cut from the web is pierced by the tip and forced onto the pin, the pin and sleeve are relatively moved from their second position toward their first position and said retainer is actuated to retain them in their first position, and a release adjacent the one cylinder downstream of the nip of the cylinders, and constructed and arranged to release said retainer when said pin and sleeve pass by said release so that said sleeve and pin relatively move to said second position and thereby strip and remove the cut piece from said pin to release the cut piece from the one cylinder.

14. The mechanism of claim 13 which also comprises a plurality of circumferentially spaced apart first keys carried by said sleeve and extending generally axially thereof, a plurality of circumferentially equally spaced apart guideways carried by said housing and complementarily engageable with said first keys for restraining rotation of said sleeve relative to said housing while permitting said sleeve to reciprocate generally axially relative to said housing, a plurality of second keys equally circumferentially spaced apart and carried by said ring and receivable in some of said guideways for guiding said ring for generally axial reciprocation relative to said housing, said followers being equally circumferentially spaced apart and carried by said ring, and a plurality of circumferentially spaced apart and inclined ramps carried by said housing and constructed and arranged to cooperate with said followers of said ring to rotatably index said ring and releasably retain the sleeve in said first position thereof.

15. The mechanism of claim 14 wherein said guideways alternate between first and second guideways having a different radial depth with said first guideways having a greater radial depth than the radial depth of said second guideways, and said second keys on said ring are slidably receivable in said second guideways and project radially sufficiently that they will overlap and cannot be received in said first guideways.

* * * * *